United States Patent [19]

Klaiber

[11] 4,294,272

[45] Oct. 13, 1981

[54] APPARATUS FOR WASHING, RINSING AND SPIN DRYING PAINT ROLLERS

[76] Inventor: William C. Klaiber, 601 York Rd., Fayetteville, N.C. 28303

[21] Appl. No.: 83,613

[22] Filed: Oct. 11, 1979

[51] Int. Cl.[3] ..... B08B 3/02

[52] U.S. Cl. ..... 134/138; 134/141; 68/213

[58] Field of Search ..... 134/138, 139, 141, 149; 68/213

[56] References Cited

U.S. PATENT DOCUMENTS

| | | | |
|---|---|---|---|
| 1,265,390 | 5/1918 | Schmitt | 134/141 |
| 3,087,190 | 4/1963 | Werner | 68/213 X |
| 3,428,060 | 2/1969 | Spivey | 134/138 X |
| 3,696,457 | 10/1972 | Hand | 134/149 X |
| 4,130,124 | 12/1978 | Sherwin | 134/138 |
| 4,130,443 | 12/1978 | Dulin | 134/149 X |

FOREIGN PATENT DOCUMENTS

| | | | |
|---|---|---|---|
| 2360884 | 6/1975 | Fed. Rep. of Germany | 134/138 |

*Primary Examiner*—Robert L. Bleutge
*Attorney, Agent, or Firm*—Harvey B. Jacobson

[57] ABSTRACT

A receptacle is provided for receiving a paint roller therein. An elongated horizontal roller support structure is journalled within the receptacle for rotation about a horizontal axis extending longitudinally of the roller support structure. The roller support structure is adapted to have a paint roller lengthwise telescoped thereover for support therefrom and rotation therewith. An elongated horizontal water discharge manifold is supported within the housing in laterally spaced relation relative to the roller support structure and for adjustable angular displacement about the longitudinal axis of the manifold. The manifold includes water outlet jet discharge structure spaced therealong and opening outwardly from one side of the manifold toward the roller support structure. The manifold includes water inlet structure for supplying water under pressure to the interior of the manifold and structure is provided on the exterior of the receptacle for adjustably angularly displacing the manifold. Structure is also provided for driving the roller support structure and the receptacle includes water outlet structure operative to drain collected water within the receptacle from within the latter down to a predetermined level spaced slightly below the axis of rotation of the roller support structure as well as a selectively operable bottom drain.

12 Claims, 4 Drawing Figures

APPARATUS FOR WASHING, RINSING AND SPIN DRYING PAINT ROLLERS

BACKGROUND OF THE INVENTION

Water based paints are used for interior and exterior painting to a large degree due to the high quality of such paints and also because rollers and brushes may be cleaned of water based paint more readily than oil or other base paints. As a result, various forms of apparatuses designed specifically to assist in cleaning paint rollers and brushes have been heretofore designed. Examples of paint roller and brush cleaners as well as other structures including some of the basic structural and operational features of the instant invention are disclosed in U.S. Pat. Nos. 1,703,946, 1,915,162, 2,831,488, 3,428,060 and 3,472,251. However, these previously known devices, while being reasonably well adapted to clean paint rollers and brushes as well as other structures through the utilization of structural and operational features similar to those of the instant invention, do not offer structure whereby paint rollers and brushes may be most effectively cleaned of water based paint with minimum effort and ease of operation. Accordingly, a need exists for and an improved paint roller and brush cleaner.

BRIEF DESCRIPTION OF THE INVENTION

The paint roller cleaner of the instant invention is constructed in a manner whereby a paint roller may be supported for rotation about its longitudinal axis and have a plurality of jets of water directed thereagainst during rotation of the roller for a thorough cleaning thereof. The cleaner is also constructed in a manner whereby cleaning water may be directed against a paintbrush supported within the cleaner and roller support structure is provided within the cleaner and removably rotatably supported therefrom for telescopingly receiving a paint roller to be cleaned. The roller support structure is journalled within a roller receiving compartment of the cleaner and a water jet outlet is provided in a turbine receiving compartment of the cleaner for discharging a jet of water toward and against a water turbine wheel mounted for rotation with the roller support structure. In this manner, the roller support structure may be driven and the cleaner further includes a water outlet manifold in the roller receiving compartment operative to discharge a plurality of jets of water toward and against a paint roller supported from the paint roller structure during rotation of the latter as well as the paint roller supported therefrom. The roller receiving compartment of the cleaner is further constructed in a manner whereby the paint roller may be rotated slowly in a solution of soap and water.

The main object of this invention is to provide a cleaner which will be effective in cleaning water based paints from paint rollers and brushes.

Another object of this invention is to provide a cleaner including structure whereby a paint roller to be cleaned may be turned slowly within a solution of soap and water.

Yet another important object of this invention is to provide a paint roller cleaner which may be readily received in a conventional sink basin and therefore utilized within a building immediately adjacent a supply of water under pressure.

A further object of this invention is to provide a paint roller cleaner constructed in a manner whereby the interior surfaces thereof may be readily cleaned.

An ancillary object of this invention is to provide a paint roller cleaner requiring only a source of water under pressure as a power source.

A final object of this invention to be specifically enumerated herein is to provide a cleaner in accordance with the preceding objects and which will conform to conventional forms of manufacture, be of simple construction and easy to use so as to provide a device that will be economically feasible long lasting and relatively trouble free in opeation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
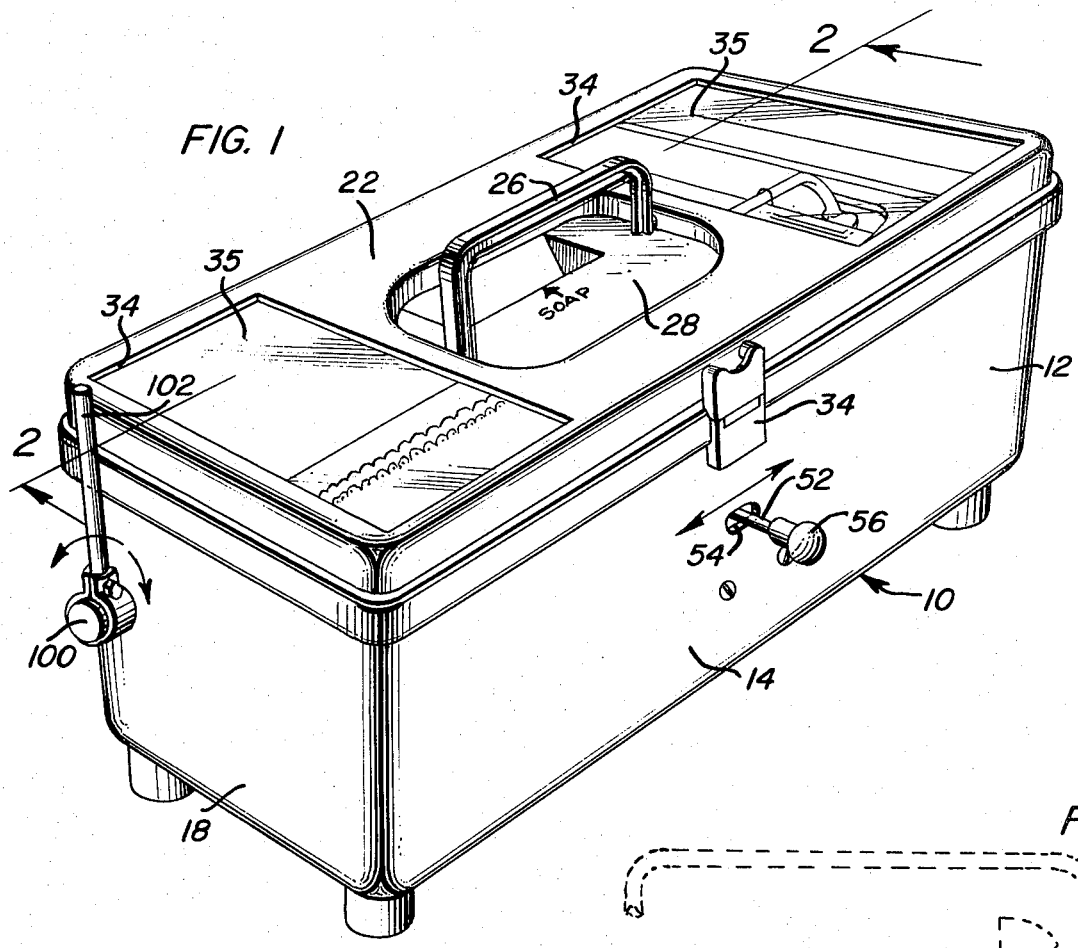
FIG. 1 is a perspective view of the paint roller cleaner with the cover of the receptacle portion thereof in a closed position.

Referring now more specifically to the drawings, the numeral 10 generally designates the roller and brush cleaner of the instant invention. The cleaner 10 includes an upwardly opening elongated housing 12 having front and rear walls 14 and 16 and opposite end walls 18 and 20. The housing 12 includes a downwardly opening cover 22 whose rear marginal portion is hingedly supported from the upper marginal edge portion of the rear wall 16 by integral hinges 24, see FIG. 2. The cover 22 includes a central bale-type handle 26 which is swingable downwardly into an upwardly opening recess 28 formed in the cover 22 and the recess 28 includes a rearwardly and downwardly inclined integral chute 30 for introducing soap into the interior of the housing 12 when the cover 22 is closed. The front marginal edge portion of the cover and the upper marginal edge portion of the front wall 14 include coacting releasable latch structures 32 and 34 whereby the cover 22 may be latched in the closed position. Further, the cover 22 includes a pair of large openings 33 formed therein closed by transparent panels 35.

The housing 12 includes a bottom wall 36 extending between and interconnecting the lower marginal edge portions of the walls 14, 16, 18 and 20 and the bottom wall includes four depending feet 38 for support of the housing 12 in elevated position relative to a horizontal support surface. The central area of the bottom wall 36 includes a water drain outlet opening 40 and a closure disk 42 overlies the bottom wall 36 and is horizontally shiftable into and out of closing registry with the opening 40. The disk 42 is supported from one end of a horizontal control arm 44 and the other end of the control arm 44 is formed integrally with the lower end of an upstanding control shaft 48 oscillatably supported from the inner surface of the front wall 14 by a bracket 50. The upper end of the control shaft 48 includes a horizontally forwardly directed control arm 52 integral therewith and the control arm 52 passes outwardly through a horizontal slot 54 formed in the front wall 14 and is equipped with a control knob 56 on its forward end. Accordingly, the control arm 52 may be oscillated back and forth from the exterior of the housing 12 in order to shift the disk 42 between positions in and out of registry with the water drain outlet opening 40.

The interior of the housing 12 includes a front to rear extending partition 58 and the partition 58 is of substantially the same height as the front and rear walls 14 and 16 between which it extends. The partition 58 is sealed relative to the inner surfaces of the front and rear walls 14 and 16 and also the upper surface of the bottom wall 36. Further, the partition 58 includes an upwardly opening notch 60 therein for purposes which will be more fully set forth.

The cover 22 includes a depending transverse partition 62 registered with the partition 58 and including a downwardly opening notch 64 registered with the notch 60.

A roller support structure referred to in general by the reference numeral 66 is provided and includes a horizontal support shaft portion 68 upon which a substantially conventional paint roller support 70 is journalled. The shaft portion 68 includes a cross shaft 72 and an upwardly directed end portion 74 terminating upwardly in a horizontally and reversely directed handle portion 76. A water turbine wheel 78 is secured to the end of the roller support structure 70 adjacent the cross shaft 72 in axially spaced relation relative to the latter and a mounting bracket 80 is supported from the inner side of the end wall 20. The mounting bracket 80 defines a pair of laterally spaced support flanges 82 defining upwardly opening notches 84 therein and an upper horizontal flange 86 defining a J-shaped notch 88 therein.

Figure 2:
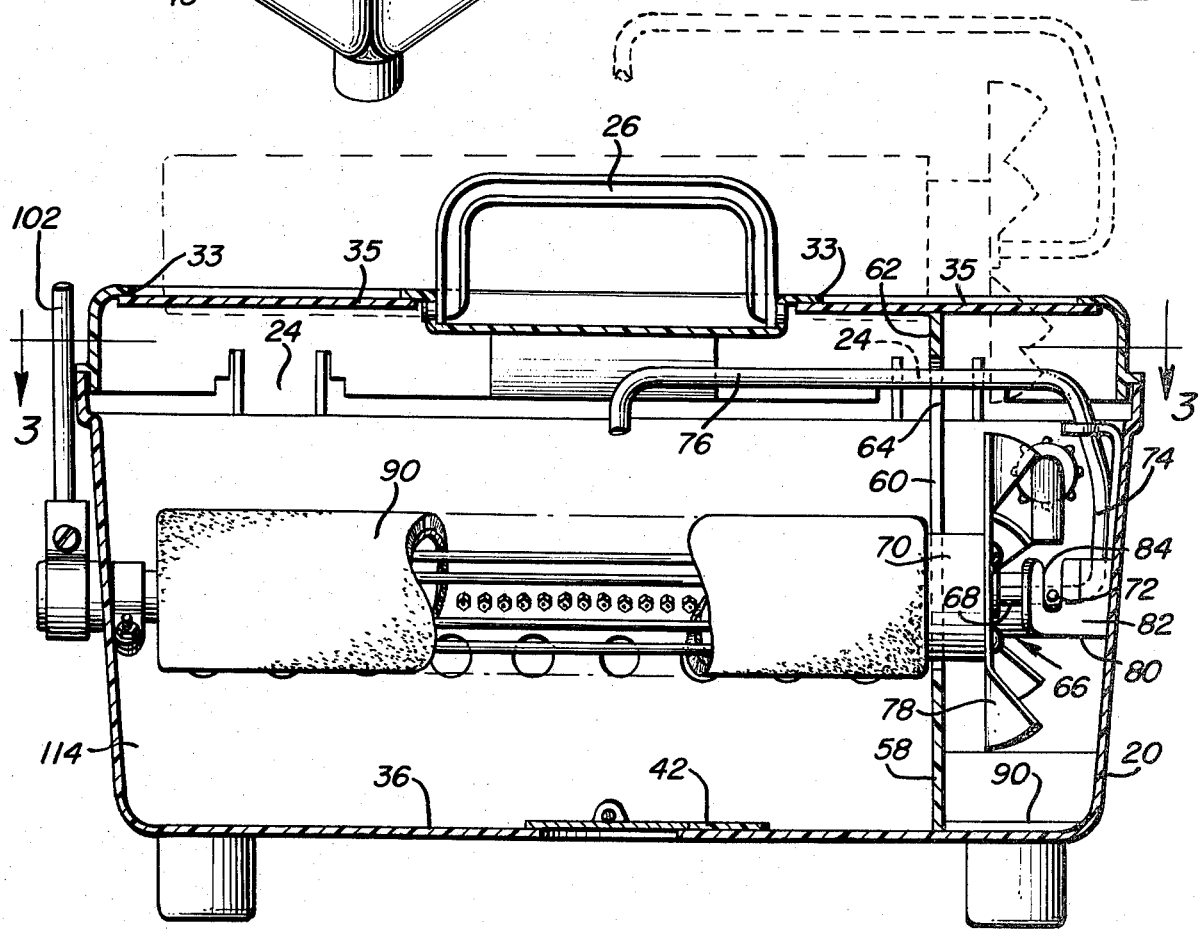
FIG. 2 is an enlarged vertical sectional view taken substantially upon the plane indicated by the section line 2—2 of FIG. 1.
Figure 3:
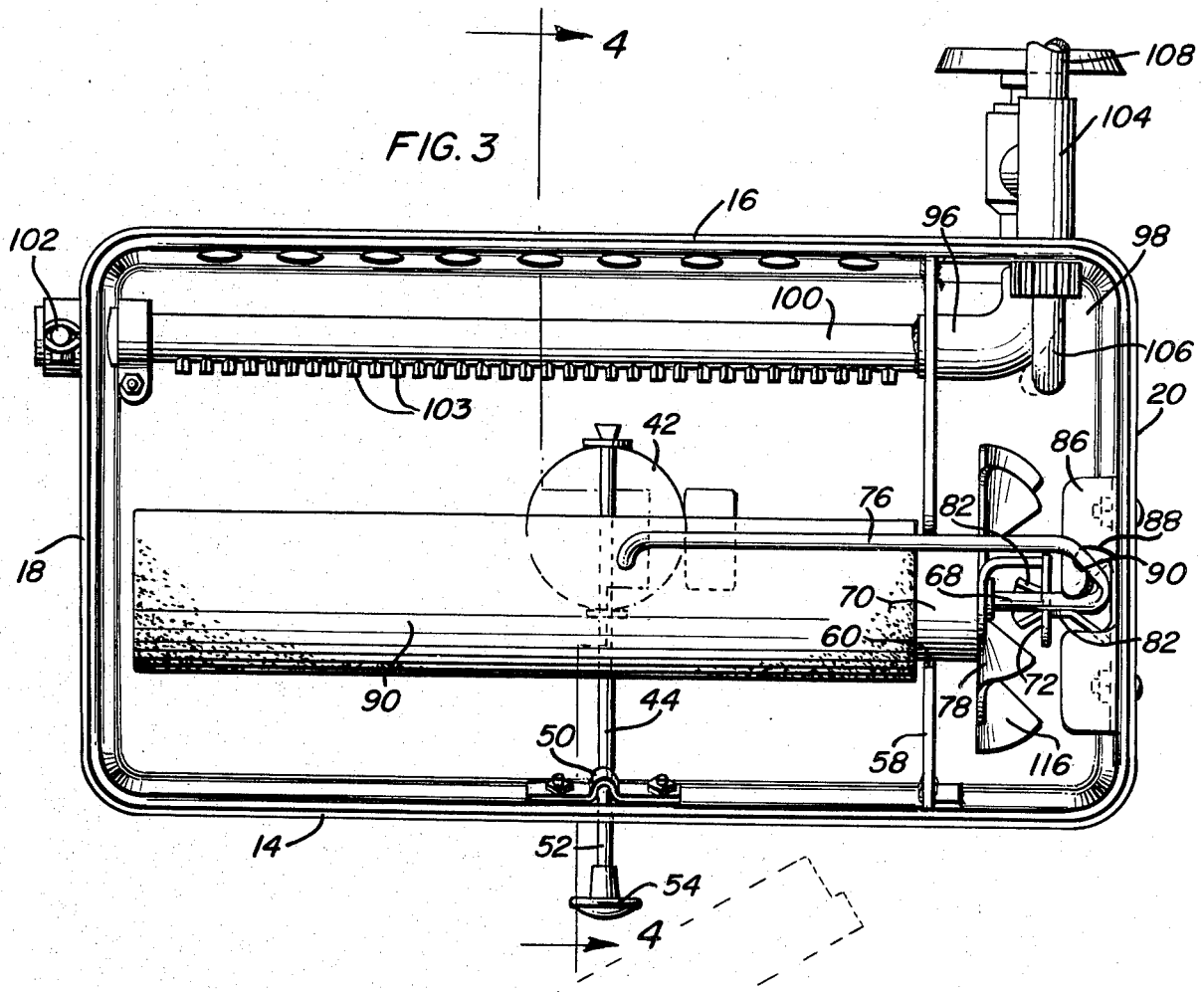
FIG. 3 is a horizontal sectional view taken substantially upon the plane indicated by the section line 3—3 of FIG. 2.
Figure 4:
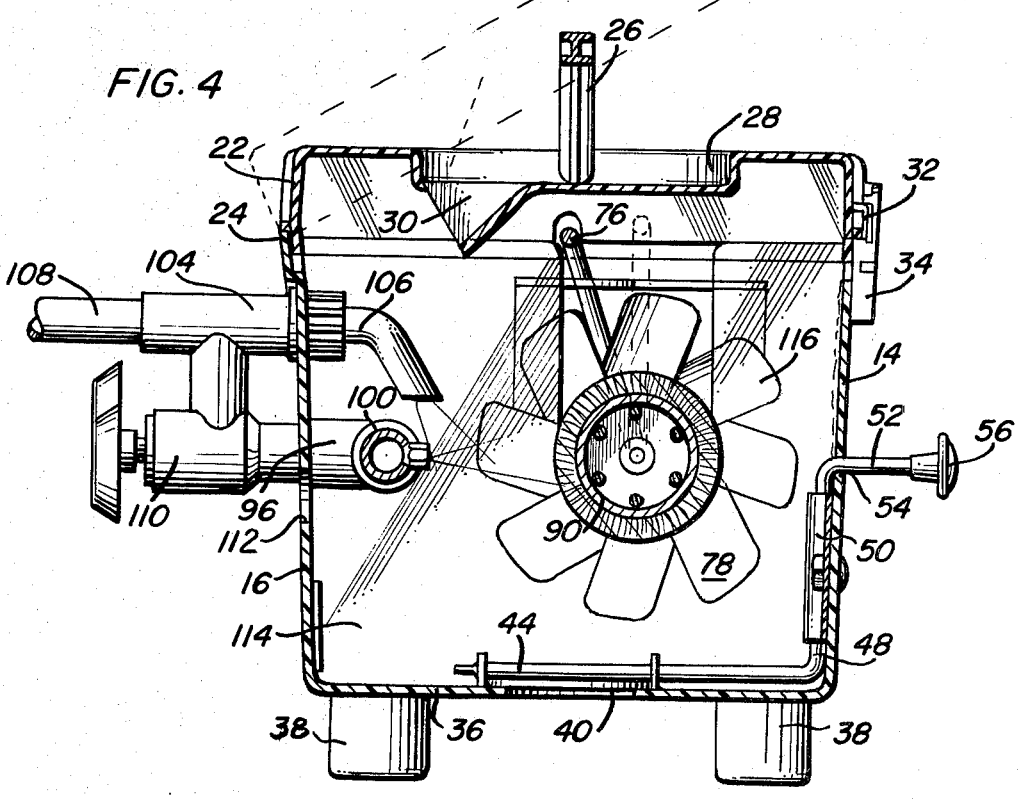
FIG. 4 is a transverse vertical sectional view taken substantially upon the plane indicated by the section line 4—4 of FIG. 3.

From FIGS. 2, 3 and 4 of the drawings, it may be seen that the shaft portion 68 and cross head 72 are downwardly receivable within the housing 12 with the support shaft portion 68 being received between the flanges 82 and the opposite ends of the cross head 72 received in the notches 84. After the roller support structure 66 has thus been positioned within the housing 12 with the notch 60 loosely receiving the adjacent end of the support 70 therethrough the handle portion 76 may be swung slightly upwardly in a clockwise direction as viewed in FIG. 2 of the drawings in order to swing the upwardly directed end portion 74 into the open end of the J-shaped notch 88 and the end portion 74 may then be seatged within the closed end 90 of the notch 88. In this manner, the support shaft portion 68 of the roller support structure 66 will be horizontally disposed within the housing 12 and a roller 90 telescoped over the paint roller supports 70 will be mounted for rotation about the longitudinal axis of the support shaft portion 68. Of course, when the roller support structure 66 is removed from the housing 12, the roller 90 may be readily telescoped over the paint roller support 70 or removed from telescoped engagement therewith.

The notch 60 receives the end of the paint roller support 70 adjacent the cross head 72 therethrough and the notch 64 snugly receives the handle portion 76 therethrough. Furthermore, it may be seen that when the cover 22 is in the closed position, the upper extremity of the notch 64 is only closely above the handle portion 76 thereby preventing the handle portion 76 from swinging sufficiently in a clockwise direction to disengage the upwardly directed end portion 74 from the closed end of the J-shaped notch 88.

The water turbine 78 is disposed between the partition 58 and the end wall 20 and the rear wall 16 includes a lower opening 92 therein through which a paint brush may be inserted into the interior of the housing from the rear side thereof. When a paintbrush is inserted into the rear of the housing 12 and disposed on the bottom wall 36, the paintbrush is spaced below the lower periphery of the water turbine 78 for water spray cleaning of the brush by water spun from the lower peripheral portion of the turbine 78.

A water inlet fitting 96 opens into the rear of the housing 12 through the turbine compartment 98 therein in which the water turbine 78 is received and the water inlet fitting 96 opens through the partition 58 and has one end of a tubular manifold 100 rotatably received therein. The other closed end of the manifold 100 is rotatably received through the end wall 18 and equipped with a generally radially outwardly projecting handle 102. The extent of the manifold 100 between the partition 58 and the end wall 18 is equipped with longitudinally spaced water jet nozzles 103 for jetting water generally radially outwardly of the manifold 100 and it therefore may be seen that strong jets of water may be discharged from the manifold 100 into engagement with the paint roller 98 supported from the paint roller support 70. In addition, the manifold 100 may be rotated a full 360° and it may therefore be utilized to direct jets of water over substantially all of the interior surfaces of the housing 10 after the roller 90 has been removed therefrom.

The cleaner 10 further includes a secondary water inlet fitting 104 opening into the housing 12 through the rear wall 16 thereof and includes an angulated water jet outlet nozzle 106 supported therefrom and angularly displaceable relative thereto about a front to rear extending horizontal axis. The nozzle 106 may therefore be positioned to direct a maximum portion of the water discharged therefrom onto the water turbine 78, or the nozzle 106 may be adjusted whereby only a small portion of the water discharged therefrom will be directed against the water turbine 78. In this manner, the speed of rotation of the paint roller support 70 may be adjusted. Further, it will be noted that the water inlet fitting 104 is provided with a water supply fitting 108 to which a supply of water under pressure may be readily communicated and the fitting 96 is communicated with the fitting 104 for receiving water therefrom through a variable flow control valve 110. In this manner, the flow of water to the nozzles 102 may be varied or terminated, if desired.

The rear wall 16 is provided with a plurality of water level controlling outlet openings 112 spaced therealong at a level slightly below the axis of rotation of the roller support 70. In this manner, water may be admitted into the interior of the housing 12 within the roller compartment 116 in which the roller 90 is disposed and allowed to accumulate to the level of the openings 112. Thereafter, the admission of water into the housing 12 may be terminated and soap may be added to the water within the housing. Then water may be supplied to the nozzle 106 on the side of the partition 58 remote from the compartment 114 and the turbine 78 may thereby cause the roller 90 to be rotated at the desired speed within a soapy solution. It will be noted that the nozzle 106 is positioned relative to the turbine 78 whereby the latter will rotate in a counterclockwise direction as viewed in FIG. 4 of the drawings. Thus, rotation of the lower periphery of the roller 90 within the water will cause the water within the compartment 114 to be driven toward the right as viewed in FIG. 4 of the drawings and to be built up on the side of the roller 90 remote from the manifold 100. In this manner, the roller 90 may be rotated in a soapy solution as long as desired and with the soapy solution level between the roller 90 and the front wall 14 considerably higher than the level at the rear wall 16. However, when it is desired to rinse the roller 90, the disk 42 may be opened and the valve 110 may be opened to admit water into the manifold 110 for spray discharging against the roller 90. Of course, it will be noted that the water discharged from the jets 103 may be directed against the center of the roller 90 or against the upper or lower peripheral portions of the roller 90 as desired. Further, once a roller has been cleaned within the housing 10, the valve 110 may be turned on for a short period and the handle 102 may be utilized to cause the manifold 100 to rotate through a complete 360° rotation whereby the entire interior of the housing 12 will be sprayed cleaned of any paint residue thereon.

Also, it will be noted from FIGS. 2 and 3 of the drawings that the leading edges of the blades 116 of the turbine 78 are curved away from any area of possible contact thereof with the user's finger. Accordingly, even if the turbine 78 is rotating at high speed and a person's finger should strike the periphery of the turbine, the person's finger does not incur any damage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A paint roller cleaner including a receptacle for receiving a paint roller therein, elongated horizontal roller support means journalled within said receptacle for rotation about an axis extending longitudinally of said roller support means, said roller support means being adapted to have a paint roller sleeve lengthwise telescoped thereover for support therefrom and rotation therewith, an elongated horizontal water discharge manifold supported within said housing in horizontally laterally spaced relation relative to said roller support means, said manifold including water outlet jet discharge means spaced therealong and opening outwardly along one side of said manifold toward said roller support means, means operative to selectively supply water under pressure to the interior of said manifold, drive means, independent of said manifold water jet discharge means, operative to drive said roller support means, said receptacle including water outlet means operative to drain collected water in said receptacle from within the latter on one side of said roller support means down to a predetermined level spaced slightly below said axis of rotation of said roller support means, said drive means being operative to drive said roller support means in a direction of rotation of said roller with the lower periphery of said roller support means being advanced toward the other side of said roller support means.

2. The combination of claim 1 wherein said drive means includes a water turbine wheel mounted on said roller support means and a water jet discharge nozzle stationarily supported from said receptacle for discharging a jet of water against said turbine wheel to drive the latter.

3. The combination of claim 2 including a partition in said housing through which one end of said roller support means extends, said partition dividing the interior of said receptacle into a paint roller receiving chamber and a water turbine chamber, said water turbine being disposed in said water turbine chamber, said manifold being disposed in said paint roller receiving chamber.

4. The combination of claim 3 wherein said water turbine is spaced above the lower extremity of said water turbine chamber, said receptacle including an upstanding wall portion defining one peripheral portion of said water turbine receiving chamber, said wall portion having a paintbrush receiving opening formed therein for receiving at least the bristle end of a paintbrush therethrough into the lower portion of said turbine chamber below said turbine.

5. The combination of claim 4 wherein said paintbrush receiving opening is formed in a lower portion of said wall portion and defines a drain opening for draining water from said turbine chamber.

6. The combination of claim 3 wherein said partition includes an upwardly opening notch formed therein upwardly through which said one end of said roller support means is removable from said receptacle.

7. A paint roller cleaner including a receptacle for receiving a paint roller therein, elongated horizontal roller support means journalled within said receptacle for rotation about an axis extending longitudinally of said roller support means, said roller support means being adapted to have a paint roller sleeve lengthwise telescoped thereover for support therefrom and rotation therewith, an elongated horizontal water discharge manifold supported within said housing in horizontally laterally spaced relation relative to said roller support means and for adjustable angular displacement about the longitudinal axis of said manifold, said manifold including water outlet discharge means spaced therealong and opening outwardly along one side of said manifold toward said roller support means, means operative to selectively supply water under pressure to the interior of said manifold, drive means operative to drive said roller support means, means operative to variably angularly displace said manifold from the exterior of said receptacle, said receptacle including water outlet means operative to drain collected water in said receptacle from within the latter down to a predetermined lever spaced slightly below said axis of rotation of said roller support means, said drive means including a water turbine wheel mounted on said roller support means and a water jet discharge nozzle stationarily supported from said receptacle for discharging a jet of water against said turbine wheel to drive the latter, a partition in said housing through which one end of said roller support means extends, said partition dividing the interior of said receptacle into a point roller receiving chamber and a water turbine receiving chamber, said water turbine being disposed in said water turbine chamber, said manifold being disposed in said paint roller receiving chamber, said water turbine being spaced above the lower extremity of said water turbine chamber, said receptacle including an upstanding wall portion defining one peripheral wall portion of said water turbine receiving chamber, said wall portion having a paintbrush receiving opening formed therein for receiving at least the bristle end of a paintbrush therethrough into the lower portion of said turbine chamber below said turbine, said paintbrush receiving opening being formed in a lower portion of said wall portion and defining a drain opening for draining water from said turbine chamber, said partition including an upwardly opening notch formed therein upwardly through which said one end of said roller support means is removable from said receptacle, said roller support means including an elongated structure over which a paint roller may be lengthwise telescoped from the other end thereof, an elongated support member from which said roller support means is journalled and including a first end projecting lengthwise outwardly of said one end of said roller support means, said first end of said support member including a cross head spaced outwardly of said one end of said roller support member and terminating outwardly in an upwardly directed portion in turn terminating upwardly in a generally horizontal back turned handle defining end spaced above said roller support means, means defining a pair of laterally spaced support flanges in said turbine chamber and having upwardly opening notches therein, said first end being received between said flanges with the opposite ends of said cross head seated in said notches, means defining an anchor flange in said turbine compartment above said support flanges, said anchor flange having a J-shaped slot formed therein including open and closed ends, the upper end portion of said upwardly directed portion being receivable in said slot through the open end thereof and seatable in the closed end of said slot with said back turned end disposed above said notch.

8. The combination of claim 7 wherein said receptacle includes a downwardly opening cover for removably closing the upper portion of said receptacle from above, said cover including a depending partition therein above the first mentioned partition and having a downwardly opening notch formed therein through which said back turned end extends when said cover is in a closed position.

9. A paint roller cleaner including a receptacle for receiving a paint roller therein, elongated horizontal roller support means journalled within said receptacle for rotation about an axis extending longitudinally of said roller support means, said roller support means being adapted to have a paint roller sleeve lengthwise telescoped thereover for support therefrom and rotation therewith, an elongated horizontal water discharge manifold supported within said housing in laterally spaced relation relative to said roller support means, said manifold including water outlet jet discharge means spaced therealong and opening outwardly along one side of said manifold means operative to selectively supply water under pressure to the interior of said manifold, drive means, independent of said manifold water jet discharge means, operative to drive said roller support means, wherein said receptacle includes water outlet means operative to drain collected water in said receptacle from within the latter down to a predetermined level spaced slightly below said axis of rotation of said roller support means, said receptacle including water outlet means operative to drain collected water in said receptacle from within the latter on one side of said roller support means down to a predetermined level spaced slightly below said axis of rotation of said roller support means, said drive means being operative to drive said roller support means in a direction of rotation of said roller with the lower periphery of said roll support means being advanced toward the other side of said roller support means.

10. The combination of claim 9 wherein said drive means includes a water turbine wheel mounted on roller support means and a water jet discharge nozzle stationarily supported from said receptacle for discharging a jet of water against said turbine to drive the latter.

11. The combination of claim 10 including a partition in said housing through which one end of said roller support means extends, said partition dividing the interior of said receptacle into a paint roller receiving chamber and a water turbine chamber, said water turbine being disposed in said water turbine chamber, said manifold being disposed in said paint roller receiving chamber.

12. A paint roller cleaner including a receptacle for receiving a paint roller therein, elongated horizontal roller support means journalled within said receptacle for rotation about an axis extending longitudinally of said roller support means, said roller support means being adapted to have a paint roller sleeve lengthwise telescoped thereover for support therefrom and rotation therewith, an elongated horizontal water discharge manifold supported within said housing in horizontally laterally spaced relation relative to said roller support means, said manifold including water outlet jet discharge means spaced therealong and opening outwardly along one side of said manifold toward said roller support means, means operative to selectively supply water under pressure to the interior of said manifold, drive means operative to drive said roller support means, said receptacle including water outlet means operative to drain collected water in said receptacle from within the latter down to a predetermined level spaced slightly below said axis of rotation of said roller support means, said drive means including a water turbine wheel mounted on said roller support means and a water jet discharge nozzle stationarily supported from said receptacle for discharging a jet of water against said turbine wheel to drive the latter, a partition in said housing through which one end of said roller support means extends, said partition dividing the interior of said receptacle into a point roller receiving chamber and a water turbine chamber, said water turbine being disposed in said water turbine chamber and said manifold being disposed in said paint roller chamber, said water turbine being spaced above the lower extremity of said water turbine chamber, said receptacle including an upstanding wall portion defining one peripheral portion of said water turbine receiving chamber, means defining a drain opening for draining water from said turbine chamber, said partition including an upwardly opening notch formed therein outwardly through which said one end of said roller support means is removable from said receptacle, said roller support means including an elongated structure over which a paint roller may be lengthwise telescoped from the other end thereof, an elongated support member from which said roller support means is journalled and including a first end projecting lengthwise outwardly of said one end of said roller support means, said first end of said support member including a cross head spaced outwardly of said one end of said roller support member and terminating outwardly in an upwardly directed portion in turn terminating upwardly in a generally horizontal back turned handle defining end spaced above said roller support means, means defining a pair of laterally spaced support flanges in said turbine chamber and having upwardly opening notches therein, said first end being received between said flanges with the opposite ends of said cross head seated in said notches, means defining an anchor flange in said turbine compartment above said support flanges, said anchor flange having a J-shaped slot formed therein including open and closed ends, the upper end portion of said upwardly directed portion being receivable in said slot through the open end thereof and seatable in the closed end of said slot with said back turned end disposed above said notch.

* * * * *